US010293468B2

(12) United States Patent
Cano

(10) Patent No.: US 10,293,468 B2
(45) Date of Patent: May 21, 2019

(54) CARD EXTRACTION DEVICES

(71) Applicant: Josie Cano, Greeley, CO (US)

(72) Inventor: Josie Cano, Greeley, CO (US)

( * ) Notice: Subject to any disclaimer, the term of this patent is extended or adjusted under 35 U.S.C. 154(b) by 0 days.

(21) Appl. No.: 15/791,263

(22) Filed: Oct. 23, 2017

(65) Prior Publication Data

US 2019/0118349 A1 Apr. 25, 2019

(51) Int. Cl.
*B25B 9/00* (2006.01)
*A45C 11/18* (2006.01)

(52) U.S. Cl.
CPC ..... *B25B 9/00* (2013.01); *A45C 11/182* (2013.01); *A45F 2200/055* (2013.01)

(58) Field of Classification Search
CPC ..... A47L 25/005; B25J 15/008; B65H 3/20; A45F 2200/0583; A45F 2200/055; B25B 9/00; A45C 11/182
See application file for complete search history.

(56) References Cited

U.S. PATENT DOCUMENTS

| | | | | |
|---|---|---|---|---|
| 1,524,399 | A * | 1/1925 | Krueger | B65D 5/46008 16/407 |
| 5,647,624 | A * | 7/1997 | Beshara, Jr. | B65D 23/104 215/395 |
| 6,375,239 | B1 * | 4/2002 | Reed | B65D 5/4208 229/117.23 |
| 8,434,803 | B1 | 5/2013 | An | |
| 2013/0170938 | A1 | 7/2013 | Lowden | |
| 2013/0228491 | A1 * | 9/2013 | Glass | B65D 73/0007 206/525 |

* cited by examiner

*Primary Examiner* — Stephen A Vu
(74) *Attorney, Agent, or Firm* — Mohr Intellectual Property Law Solutions, PC

(57) ABSTRACT

Apparatuses and methods of operating the same are described. An apparatus may include a substrate that is formed of substantially flexible material. The substrate may include a first portion, a second portion, and a fold line. The first portion may include an inner surface with an adhesive material. The second portion may include an inner surface with an adhesive material. The fold line between the first portion and the second portion which enables the substrate to be folded. The fold line may extend from a location at an edge of the substrate. A bottom part of the inner surface of the first portion and the second portion may adhere to a front and back surface of a card and a middle part of the inner surface of the first portion and the second portion may adhere to an edge of the card.

16 Claims, 7 Drawing Sheets

CARD EXTRACTION DEVICES

BACKGROUND

Wallets, purses, business pad portfolios, and personal planners may hold cards such as credit cards, debit cards, identification cards, insurance cards, and so forth. The cards are typically placed in card slots of the wallets, purses, business pad portfolios, and personal planners. For some individuals, it can be difficult to pull the cards out of a wallet, a purse, a business pad portfolio, or a personal planner.

SUMMARY

A device that may include a substrate that is formed of substantially flexible material. The substrate may include a first portion, a second portion, and a fold line. The first portion may include an inner surface with an adhesive material. The second portion may include an inner surface with an adhesive material. The substrate may include a fold line between the first portion and the second portion which enables the substrate to be folded. The fold line may extend from a location at an edge of the substrate. A bottom part of the inner surface of the first portion and the second portion may adhere to a front and back surface of a card and a middle part of the inner surface of the first portion and the second portion may adhere to an edge of the card.

BRIEF DESCRIPTION OF THE DRAWINGS

The present description will be understood more fully from the detailed description given below and from the accompanying drawings of various embodiments of the present invention, which, however, is not to be taken to limit the present invention to the specific embodiments, but are for explanation and understanding only.

DETAILED DESCRIPTION

Figure 1A:
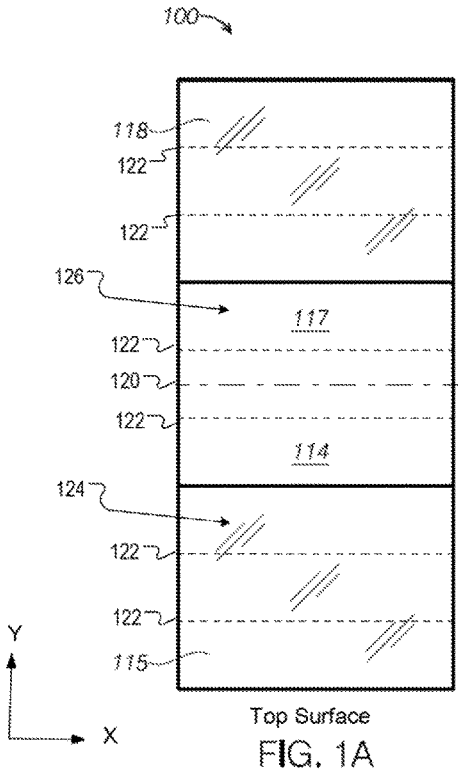
FIG. 1A illustrates a top view of a card extraction device with a first portion, a second portion, and a fold line, according to an embodiment.

The disclosed card extraction device will become better understood through review of the following detailed description in conjunction with the figures. The detailed description and figures provide merely examples of the various card extraction devices described herein. Those skilled in the art will understand that the disclosed examples may be varied, modified, and altered without departing from the scope of the card extraction device described herein. Many variations are contemplated for different applications and design considerations; however, for the sake of brevity, each and every contemplated variation is not individually described in the following detailed description.

Throughout the following detailed description, examples of various card extraction device are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader is to understand that a given feature need not be the same or similar to the specific portrayal of a related feature in any given figure or example.

An individual may possess several plastic or laminated cards. The cards may serve a wide variety of purposes including identification, proof of membership, or to facilitate financial transactions. Many of the cards may be approximately the same standard size so that the card fit into pockets or sleeves (referred to hereafter as card slots) of wallets, purses, business pad portfolios, personal planners, or other card holding devices. A card slot may be slightly wider than a card and have a depth such that a small portion of the card protrudes from the card slot so that the card may be identified, gripped, and removed by an individual when the individual desires to use the card.

The card slots may be stacked on top of each other or cascading and are slightly offset in a depth direction from one another to allow an individual to stack multiple cards in a compact space. The size of the card slot, the small portion of the card that protrudes from the card slot, or the stacking of the card slot may make it difficult for a user of a wallet, a purse, a business pad portfolio, or a personal planner to pull a card out of a card slot. Users with long fingernails, large fingers, poor dexterity, or poor eyesight may also have trouble pulling a card out of a card slot.

The embodiments described herein may, therefore, include a card extraction device that may be attached to a card to increase the ease with which an individual may remove a card from a card slot. The card extraction device may be a substrate with a first portion, a second portion, and a fold line. The card extraction device may be applied to an edge of the card to assist a user in extracting the card from a card slot.

FIG. 1A illustrates a top view of a card extraction device 100 with a first portion 114, a second portion 117, and a fold line 120, according to an embodiment. The card extraction device 100 may be a substrate. The substrate may be made of substantially flexible material. For example, the card extraction device 100 may be a polypropylene material, a polyester material, a nylon material, a polyethylene material, a plastic material, a rubber material, a metal material, and so forth. In one embodiment, a top surface of the card extraction device 100 may be a smooth surface. In another embodiment, the top surface may be a non-adhesive surface. In another embodiment, the top surface of the card extraction device 100 may be a textured surface to increase a grippability of the top surface.

The card extraction device 100 may be divided into the first portion 114 and the second portion 117 by the fold line 120. The fold line 120 may be a defined line that extends from a first edge of the card extraction device 100 to a second edge of the card extraction device 100. The fold line 120 may be a perforated line that enables the substrate to be folded along the fold line 120 to separate the card extraction device 100 into the first portion 114 and the second portion 117.

The substrate may include multiple fold lines 120 and 122. The fold lines 120 and 122 may be substantially parallel to a longitudinal axis (also referred to as an X-axis) that extends from a first edge of the card extraction device 100 to a second edge of the card extraction device 100. The multiple fold lines 120 and 122 may be located at different heights along the card extraction device 100 and may provide a user different locations along the card extraction device 100 to fold and divide the card extraction device 100 into the first portion 114 and the second portion 117. The different locations of the fold lines 120 and 122 may enable a user to adjust a length of the first portion 114 and the second portion 117. The fold lines 120 or 122 used to separate the first portion 114 from the second portion 117 may be user-defined. In one example, when a user folds the card extraction device 100 along the fold line 120, the user may divide the first portion 114 and the second portion 117 into equal lengths. In another example, the user may fold the substrate along one of the fold lines 122 and divide the card extraction device 100 so that the first portion 114 is shorter or longer in length than the second portion 117. The lengths of the first portion 114 and the second portion 117 may vary based on the type of card it is applied to or a preference of a user.

In one example, at least a first segment 115 of the first portion 114 may be transparent or semi-transparent to provide a transparent window for a user to see a portion of a front of a card located below the first segment 115. For example, when the card extraction device 100 is attached to a card, the first segment 115 may provide a transparent or semi-transparent window for an individual to see information located on the card below the first segment 115. In another example, a second segment 124 of the first portion 114 may be non-transparent or opaque. The second segment 124 may include color or pattern to aid a user in identifying a card the card extraction device 100 is attached to.

In another example, at least a first segment 118 of the second portion 117 may be transparent or semi-transparent to provide a transparent window for a user to see a portion of a back of the card located below the first segment 118. For example, when the card extraction device 100 is attached to the card, the first segment 118 may provide a transparent or semi-transparent window for an individual to see information located on the card below the first segment 118. In another example, a second segment 124 of the first portion 114 may be non-transparent or opaque. The second segment 124 may include color or pattern to aid a user in identifying a card that the card extraction device 100 is attached to.

In another example, the entire first portion 114 and/or the entire second portion 117 may be a non-transparent or opaque to provide a uniform color or pattern across the top surface of the card extraction device 100.

Figure 1B:
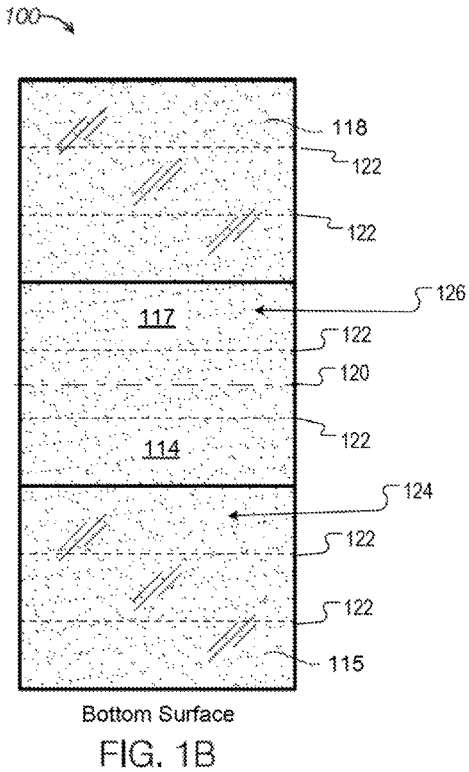
FIG. 1B illustrates a bottom view of the card extraction device in FIG. 1A with an adhesive material on a bottom surface of the card extraction device, according to an embodiment.

FIG. 1B illustrates a bottom view of the card extraction device 100 in FIG. 1A with an adhesive material on a bottom surface of the card extraction device 100, according to an embodiment. Some of the features in FIG. 1B are the same or similar to some of the features in FIG. 1A as noted by same reference numbers, unless expressly described otherwise.

In one embodiment, a bottom surface of the card extraction device 100 may include the adhesive material. When the card extraction device 100 is folded along the fold line 120 or one of the fold lines 122 and applied to the card, the adhesive may fasten or fix the card extraction device 100 to a portion of the card. For example, when the first portion 114 of the card extraction device 100 is applied to the card, the adhesive may fasten the first portion 114 to a front of the card. In another example, when the second portion 117 of the card extraction device 100 is applied to the card, the adhesive may fasten the second portion 117 to a back of the card.

In one embodiment, approximately the entire bottom surface of the card extraction device 100 may include the adhesive material. In another embodiment, a first portion of the bottom surface of the card extraction device 100 may include the adhesive material and a second portion of the bottom surface of the substrate may be non-adhesive. For example, the first segment 115 of the first portion 114 and the first segment 118 of the second portion 117 may include the adhesive material and the second segment 124 of the first portion 114 and the second segment 126 of the second portion 117 may be non-adhesive. In one embodiment, the adhesive material at the first segment 115 of the first portion 114 may be a different adhesive material than the adhesive material at the first segment 118 of the second portion 117. In another embodiment, the adhesive material at the first segment 115 of the first portion 114 may be the same as the adhesive material at the first segment 118 of the second portion 117. In another embodiment, the adhesive material may be a permanent adhesive to permanently fix the card extraction device 100 to the card. In another embodiment, the adhesive material may be a temporary or removable adhesive that may fix the card extraction device 100 to the card until the user desires to remove the adhesive, at which time the user may remove the card extraction device 100 from the card.

Figure 2A:
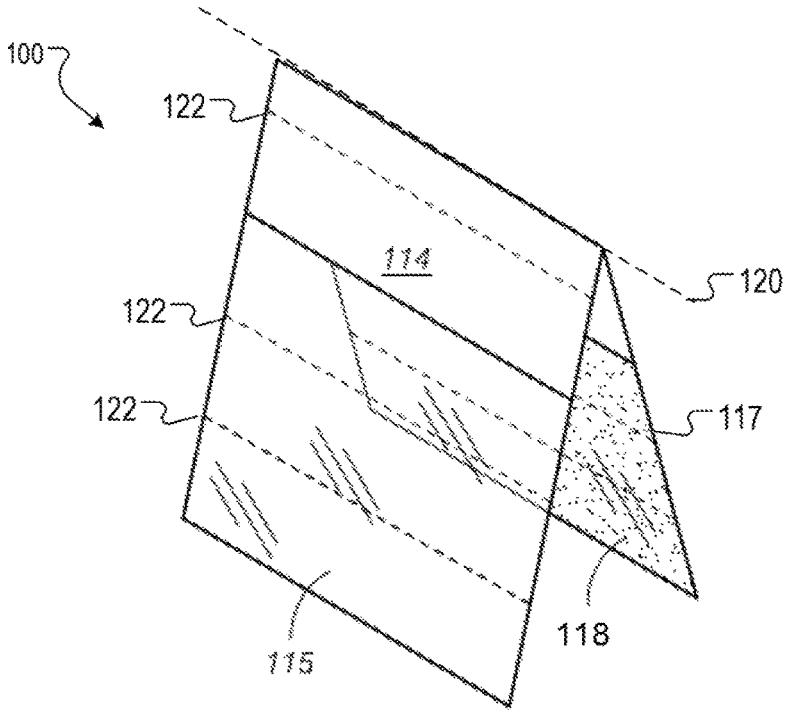
FIG. 2A illustrates a front perspective view of the card extraction device folded along the fold line, according to an embodiment.

FIG. 2A illustrates a front perspective view of the card extraction device 100 folded along the fold line 120, according to an embodiment. Some of the features in FIG. 2A are the same or similar to some of the features in FIGS. 1A and 1B as noted by same reference numbers, unless expressly described otherwise.

The card extraction device 100 may be folded along the fold line 120 to provide a first portion 114 and a second portion 117. The fold line 120 is formed to fold where the first portion 114 of the card extraction device 100 and the second portion 117 of the card extraction device 100 meet, which may enable the first portion 114 of the card extraction device 100 to fold relative to the second portion 117 of the card extraction device 100. For example, the card extraction device 100 may be folded along the fold line 120 to attach the first portion 114 to a front of a card and the second portion 117 to a back of the card. The first segment 115 of the first portion 114 may be a transparent window to enable a user to see information through the first segment 115 of the first portion 114 when the card extraction device 100 is attached to the card.

In one embodiment, when the card extraction device 100 is folded along the fold line 120, the substrate may be a substantially triangular shape. In another embodiment, when the card extraction device 100 is folded along the fold lines 120 or 122, the top surface of the card extraction device 100 may be referred to as an outer surface as it faces away from a front or back surface of the card when applied to the card. Additionally, when the card extraction device 100 is folded along the fold lines 120 or 122, the bottom surface of the card extraction device 100 may be referred to as an inner surface as it faces the front and back surfaces of the card when the substrate is applied to the card.

Figure 2B:
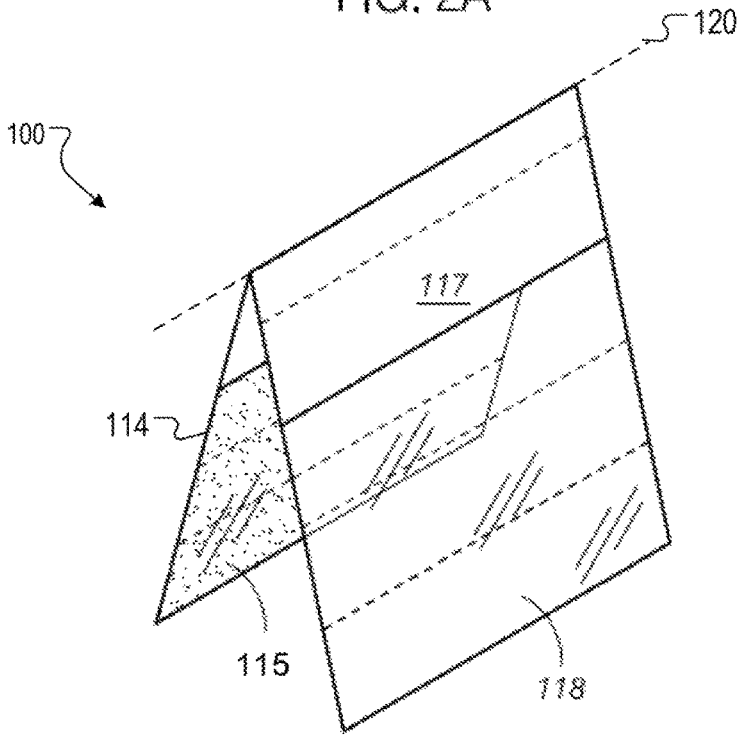
FIG. 2B illustrates a rear perspective view of the card extraction device in FIG. 2A, according to an embodiment.

FIG. 2B illustrates a rear perspective view of the card extraction device 100 in FIG. 2A, according to an embodiment. Some of the features in FIG. 2B are the same or similar to some of the features in FIGS. 1A, 1B, and 2A as noted by same reference numbers, unless expressly described otherwise.

The card extraction device 100 may be folded along the fold line 120 to provide a first portion 114 and a second portion 117. The fold line 120 is formed to fold where the first portion 114 of the card extraction device 100 and the second portion 117 of the card extraction device 100 meet, which may enable the first portion 114 of the card extraction device 100 to fold relative to the second portion 117 of the card extraction device 100. The first segment 118 of the second portion 117 may be a transparent window to enable a user to see information through the first segment 118 of the second portion 117 when the card extraction device 100 is attached to the card.

Figure 3A:
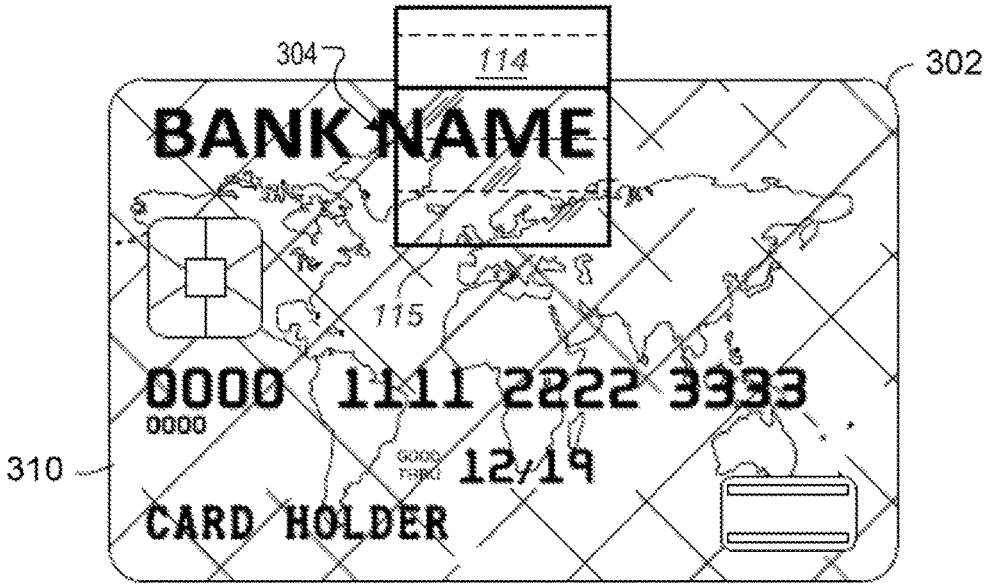
FIG. 3A illustrates a front perspective view of the card extraction device attached to a card, according to an embodiment.

FIG. 3A illustrates a front perspective view of the card extraction device 100 attached to a card 302, according to an embodiment. Some of the features in FIG. 3A are the same or similar to some of the features in FIGS. 1A-1B and 2A-2B as noted by same reference numbers, unless expressly described otherwise.

The card 302 may be a debit card, a credit card, a driver's license, a student identification card, or other types of card 302. The card extraction device 100 may be attachable to the card 302 to aid a user in removing the card 302 from a card slot of a card carrier. The front 310 of the card 302 may include information 304 imprinted, engraved, or embossed onto a surface of the card 302. The first segment 115 of the first portion 114 may be transparent to provide the user a window to see the information 304 that is beneath the first segment 115 of the first portion 114.

Figure 3B:
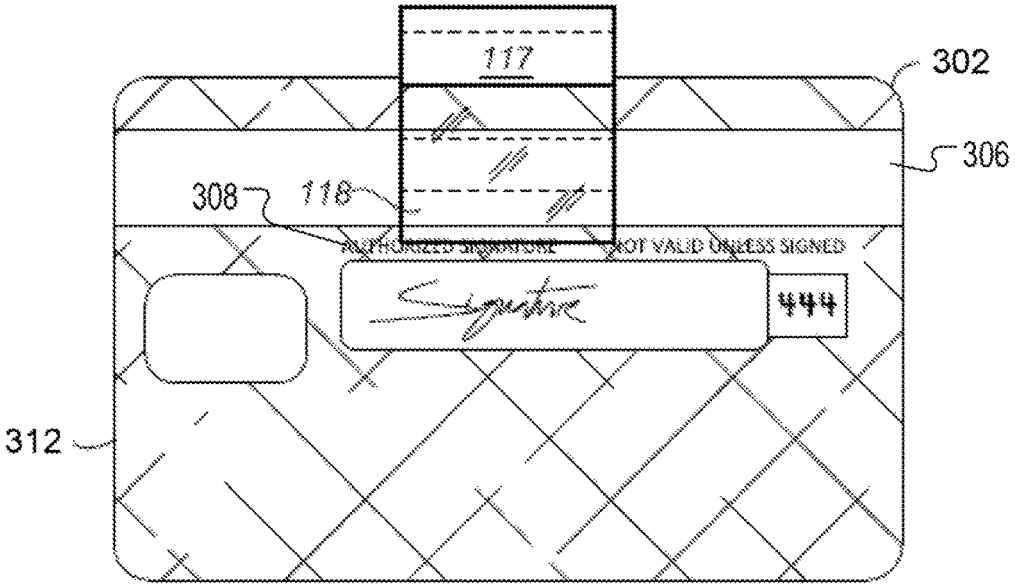
FIG. 3B illustrates a rear perspective view of the card extraction device in FIG. 3A attached to the card, according to an embodiment.

FIG. 3B illustrates a rear perspective view of the card extraction device 100 in FIG. 3A attached to the card 302, according to an embodiment. Some of the features in FIG. 3B are the same or similar to some of the features in FIGS. 1A-1B, 2A-2B, and 3A as noted by same reference numbers, unless expressly described otherwise.

The back 312 of the card 302 may include a magnetic strip 306 that is used by a card reading device when the card is used for a transaction, such as a financial transaction. In one embodiment, the first segment 118 of the second portion 117 may be transparent to provide the user a window to see the magnetic strip 306 or information 308 that is beneath the first segment 118 of the second portion 117. In another embodiment, at least the first segment 118 of the second portion 117 may be a permeable material that allows a transfer of energy or data between the card and a card-reading device through the card extraction device 100. The permeable material may be plastic, rubber, polyurethane, and so forth.

Figure 4:
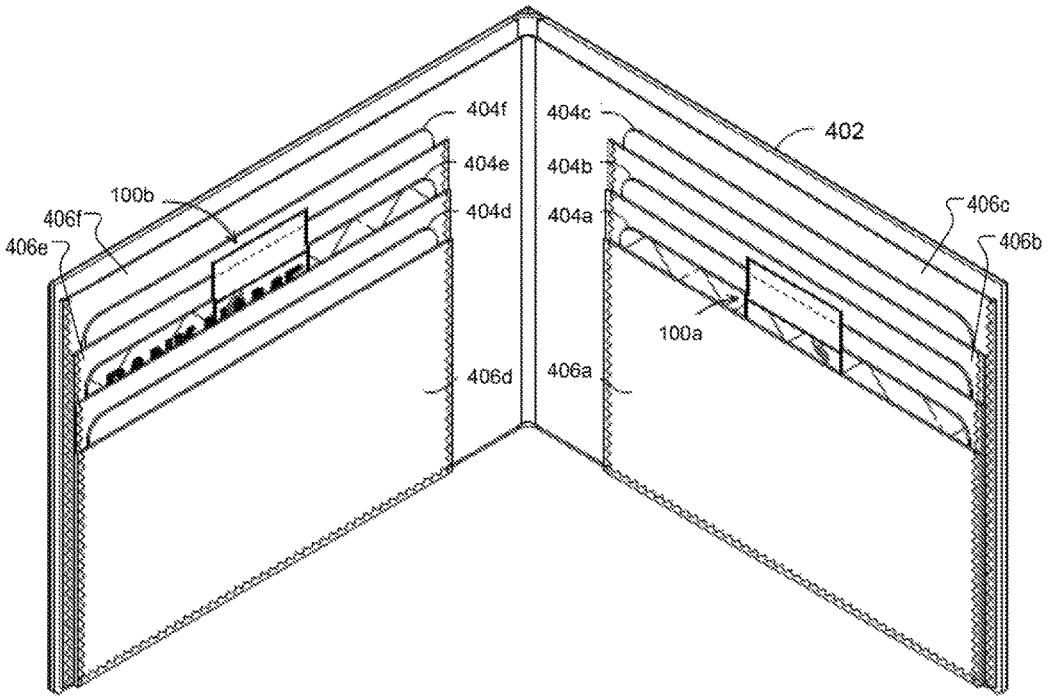
FIG. 4 illustrates a card with card extraction device located in credit card slot that is located in a credit card slot of a wallet, according to an embodiment.

FIG. 4 illustrates a card 404*a* with a card extraction device 100*a* located in credit card slot 406*a* of wallet 402 and a card 404*e* with a card extraction device 100*b* that are located in the credit card slot 406*e* of wallet 402, according to an embodiment. The card extraction devices 100*a* and 100*b* may substantially correspond to the card extraction device 100 in FIGS. 1, 2A-2B, and 3A-3B.

The wallet 402 may include card slots 406*a*, 406*b*, 406*c*, 406*d*, 406*e*, and 406*f* into which cards 404*a*, 404*b*, 404*c*, 404*d*, 404*e*, and 404*f* may be placed, respectively. The card extraction device 100*a* may be attached to card 404*a* and the card extraction device 100*b* may be attached to card 404*e*. A user may grip the card extraction devices 100*a* and 100*b* to remove the corresponding cards 404*a* and 404*e* from the corresponding card slots 406*a* and 406*e* of the wallet 402. In one embodiment, the card extraction devices 100*a* and 100*b* may aid people with long fingernails, large fingers, limited dexterity, a large number of cards in their wallet, or who carry small and compact wallets with a limited number of sleeves for card slots, because the card extraction devices 100*a* and 100*b* may aid a user in removing cards 404*a* and 404*e* from the wallet 402.

In another embodiment, the card extraction devices 100*a* and 100*b* may aid the user in organizing the cards 404*a* and 404*e* in the wallet 402. For example, a portion of the card extraction device 100*a* or 100*b* (such as the second segment 126 in FIGS. 1, 2A-2B, and 3A-3B) may have a design or other graphics printed or placed upon it for identification or decoration. The design may be a logo, a brand, a cartoon character, an image, and so forth.

Figure 5A:
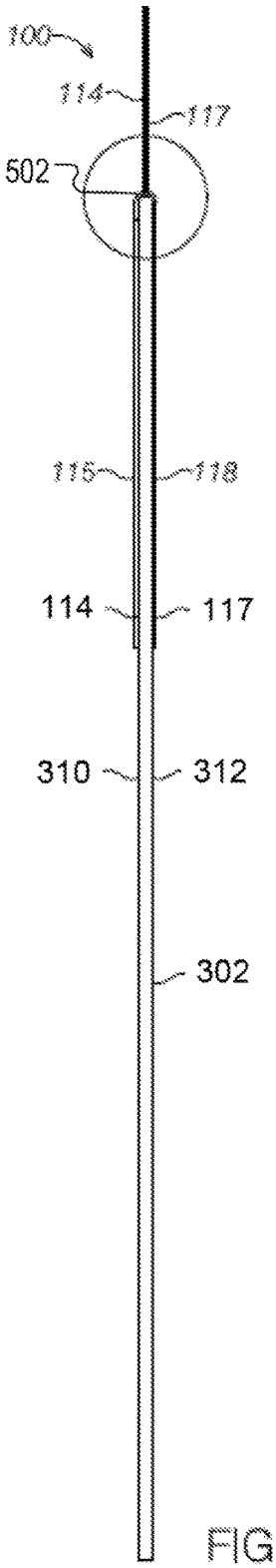
FIG. 5A illustrates a side view of a card extraction device attached to a card, according to an embodiment.

FIG. 5A illustrates a side view of the card extraction device 100 attached to the card 302, according to an embodiment. Some of the features in FIG. 5A are the same or similar to some of the features in FIGS. 1A-1B, 2A-2B, 3A-3B, and 4 as noted by same reference numbers, unless expressly described otherwise.

The card extraction device 100 may be attachable to the card 302 and may be useable to pull the card 302 out of a card slot of a wallet. As discussed above, the card extraction device 100 may be folded along a fold line to form the first segment 115 of the card extraction device 100 and the second portion 117 of the card extraction device 100. An inner surface of the first segment 115 may include an adhesive material and an inner surface of the second portion 117 may include the adhesive material.

A bottom part of the inner surface of the first portion 114 may be attached to a part of the front 310 of the card 302 to adhere to part of the front 310 of the card 302. A bottom part of the inner surface of the second portion 117 may be attached to a part of the back 312 of the card 302 to adhere to part of the back 312 of the card 302. In one embodiment, the bottom part of the first portion 114 and/or the second portion 117 may include one or more hooks 314 to attach the card extraction device 100 to the card 302. In one embodiment, the hooks 314 may be pressed into a portion of the card 302 to anchor the card extraction device 100 to the card 302. In another embodiment, the hooks 314 may be shaped to catch or grip uneven surfaces of the card 302, such as raised lettering, to anchor the card extraction device 100 to the card 302.

Figure 5B:
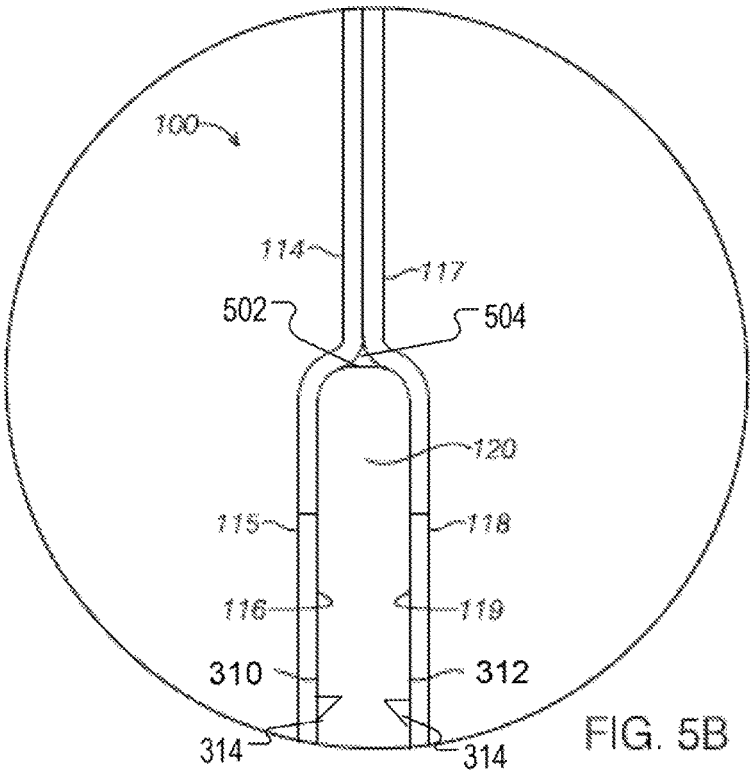
FIG. 5B illustrates that only a portion of a middle part of the inner surface of the first portion may be attached to the edge of the card and only a portion of the middle part of the inner surface of the second portion may be attached to the edge of the card, according to an embodiment.
Figure 5C:
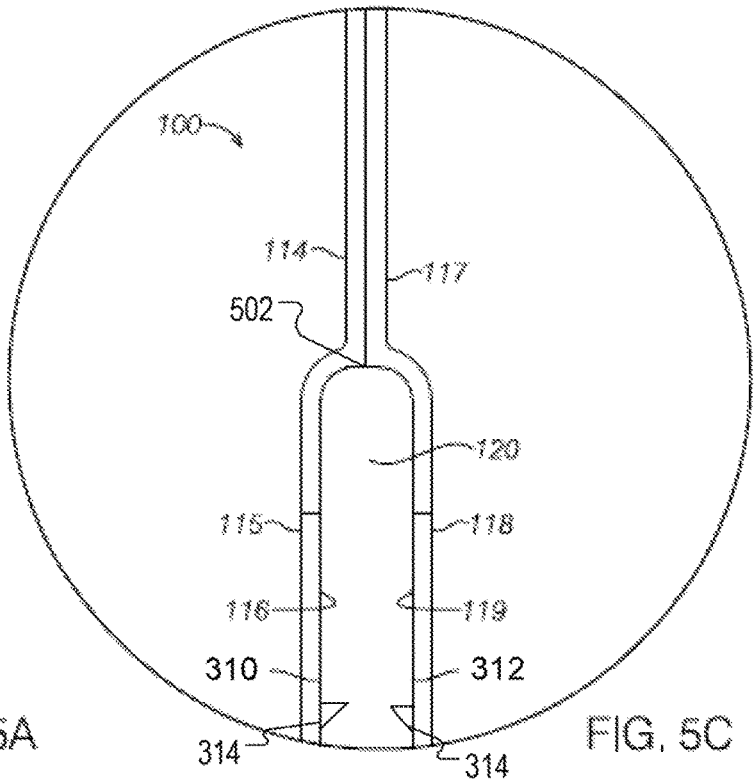
FIG. 5C illustrates that substantially all of the middle part of the inner surface of the first portion may be attached to an edge of the card and substantially all of the middle part of the inner surface of the second portion may be attached to the edge of the card, according to an embodiment.

FIGS. 5B and 5C illustrate exploded views of different embodiments of attaching a middle part of the inner surface of the first portion 114 to the edge 502 of the card 302 and attaching a middle part of the inner surface of the second portion 117 to the edge 502 of the card 302.

FIG. 5B illustrates that only a portion of middle part of the inner surface of the first portion 114 may be attached to an edge 502 of the card 302 and only a portion of the middle part of the inner surface of the second portion 117 may be attached to the edge 502 of the card 302, according to an embodiment. Some of the features in FIG. 5B are the same or similar to some of the features in FIGS. 1A-1B, 2A-2B, 3A-3B, 4, and 5A as noted by same reference numbers, unless expressly described otherwise. The remaining portion of the inner surface of the first portion 114 and the remaining portion of the inner surface of the second portion 117 may not be attached to the edge 502 of the card 302 and may form a gap 504 between the first portion 114, the second portion 117, and the edge 502 of the card 302.

FIG. 5C illustrates that substantially all of the middle part of the inner surface of the first portion 114 may be attached to an edge 502 of the card 302 and substantially all of the middle part of the inner surface of the second portion 117 may be attached to the edge 502 of the card 302, according to an embodiment. Some of the features in FIG. 5C are the same or similar to some of the features in FIGS. 1A-1B, 2A-2B, 3A-3B, 4, and 5A-SB as noted by same reference numbers, unless expressly described otherwise. In one example, there may be substantially no gap between the first portion 114, the second portion 117, and the edge 502 of the card 302. The middle part of the inner surface of the first portion 114 and the second portion 117 attaching to the edge 502 without a gap may enable the card extraction device 100 to fully adhere to the card 302. When the card extraction device 100 fully adheres to the card 302, including the edge 502, the card extraction device 100 is attached to additional surface area of the card 302. When the card extraction device 100 is used to pull the card 302 from a card slot, the additional surface area may provide an additional area for the card extraction device 100 to pull on and enable a user to more easily or more quickly pull the card 302 from the card slot because the force to pull the card 302 from the card slot is dispersed over a greater area. Additionally, the card extraction device 100 fully adhering to the card 302 may remove a weak point from the card extraction device 100, as a gap between the card extraction device 100 and the card may provide a point on the card extraction device 100 where the card extraction device 100 is not attached to anything and may be more likely to rip or tear.

Returning to FIG. 5A, a top part of the inner surface of the first portion 114 may be attached to a top part of the inner surface of the second portion 117, or vice versa. The top parts of the inner surface of the first portion 114 and the second portion 117 may extend away from the card 302 when the card extraction device 100 is attached to the card 302 to provide a user a portion to grip the card extraction device 100 and remove the card 302 from a card slot.

To attach portions of card extraction device 100 to the card 302 and to other portions of the card extraction device 100, the portions of the card extraction device 100 may be pressed onto the card 302 and the other portions of the card extraction device 100 to enable the adhesive to adhere to the card 302 and to other portions of the card extraction device 100.

In one embodiment, the adhesive may be removably attached to the card 302. For example, the adhesive may be peeled away from the card 302 after the card extraction device 100 is attached to the card 302 to remove the card extraction device 100 from the card 302. After being removed, the card extraction device 100 may be reattached to the card 302. For example, the card extraction device 100 may be temporarily removed from the card 302 when the card is being used with a card reading device, such as an automated teller machine (ATM), and then reattached to the card 302 after the card 302 is no longer being used with the card reading device.

In another embodiment, the adhesive may be a permanent adhesive to fix the card extraction device 100 to the card 302. The card extraction device 100 may be flexible so that it folds over when inserted into the card reading device. For example, the first portion 114 and the second portion 117 may form a substantially flattened body when attached to the card that may be flexible or bendable to be flattened against a front 310 or back 312 of the card 302.

The card extraction device 100 may also include material that does not block the card reading device from reading the card. For example, the card extraction device 100 may be a relatively thin plastic material that may not block radio waves. In another example, the material of the card extraction device 100 may be metal or other materials that may block radio waves. The card extraction device 100 may block the radio waves to block identity thieves from using card skimmers to steal information from the card 302. In one embodiment, the card extraction device 100 may include weather-proof material. In another embodiment, the card extraction device 100 may include tear-resistant material.

Figure 6:
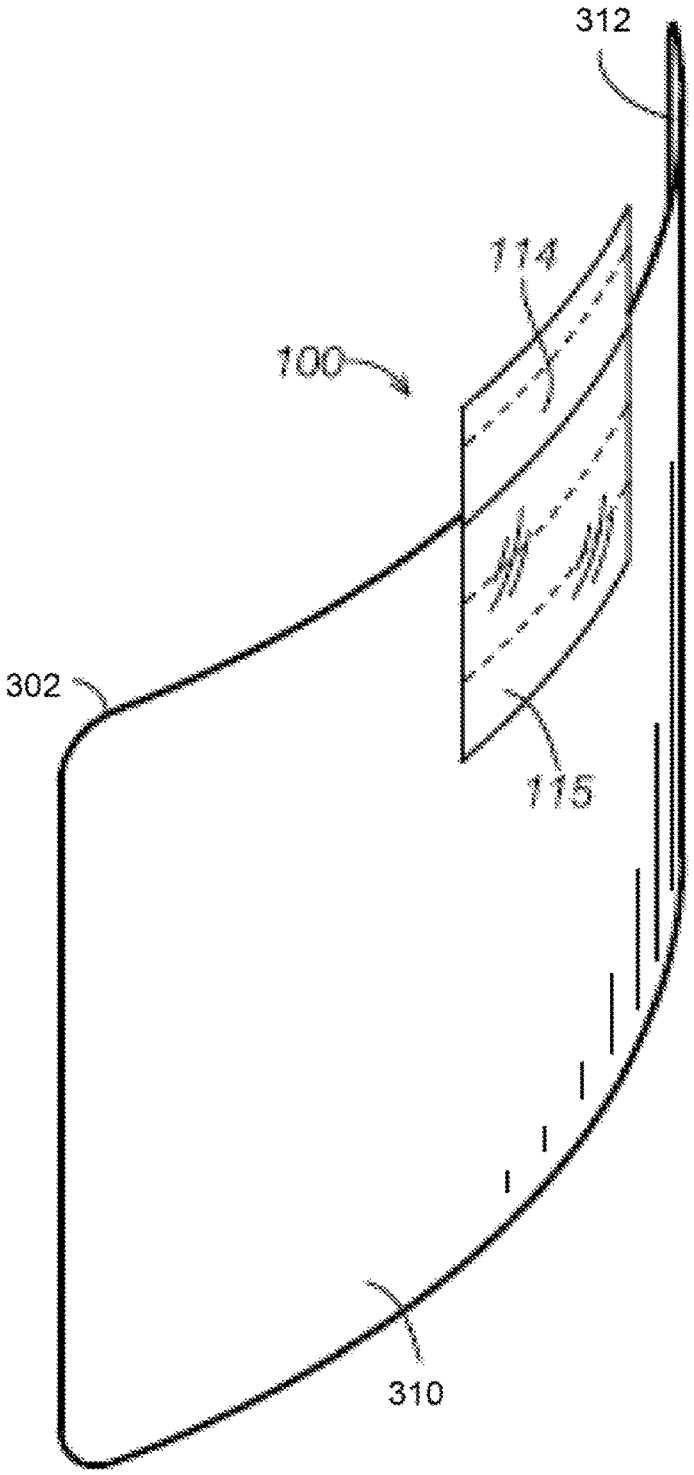
FIG. 6 illustrates a side perspective view of the card extraction device attached to a card where the card and the card extraction device are flexing, according to an embodiment.

FIG. 6 illustrates a side perspective view of the card extraction device 100 attached to a card 302 where the card 302 and the card extraction device 100 are flexing, according to an embodiment. As discussed above, the card extraction device 100 may be made of flexible material. The card extraction device 100 may flex with the card 302 as the card 302 flexes. For example, the card 302 may be inserted into a card slot of a daily planner. As the daily planner is used by an individual, the planner may flex as it is put into a bag, placed underneath other objects, or written on. As the planner flexes, the flexing may also cause the card 302 to flex. As the card 302 flexes, the card extraction device 100 may also flex with card 302. The flexibility of the card extraction device 100 may allow the card extraction device 100 to continue to adhere to the card 302 as the card 302 flexes or bends.

Figure 7:
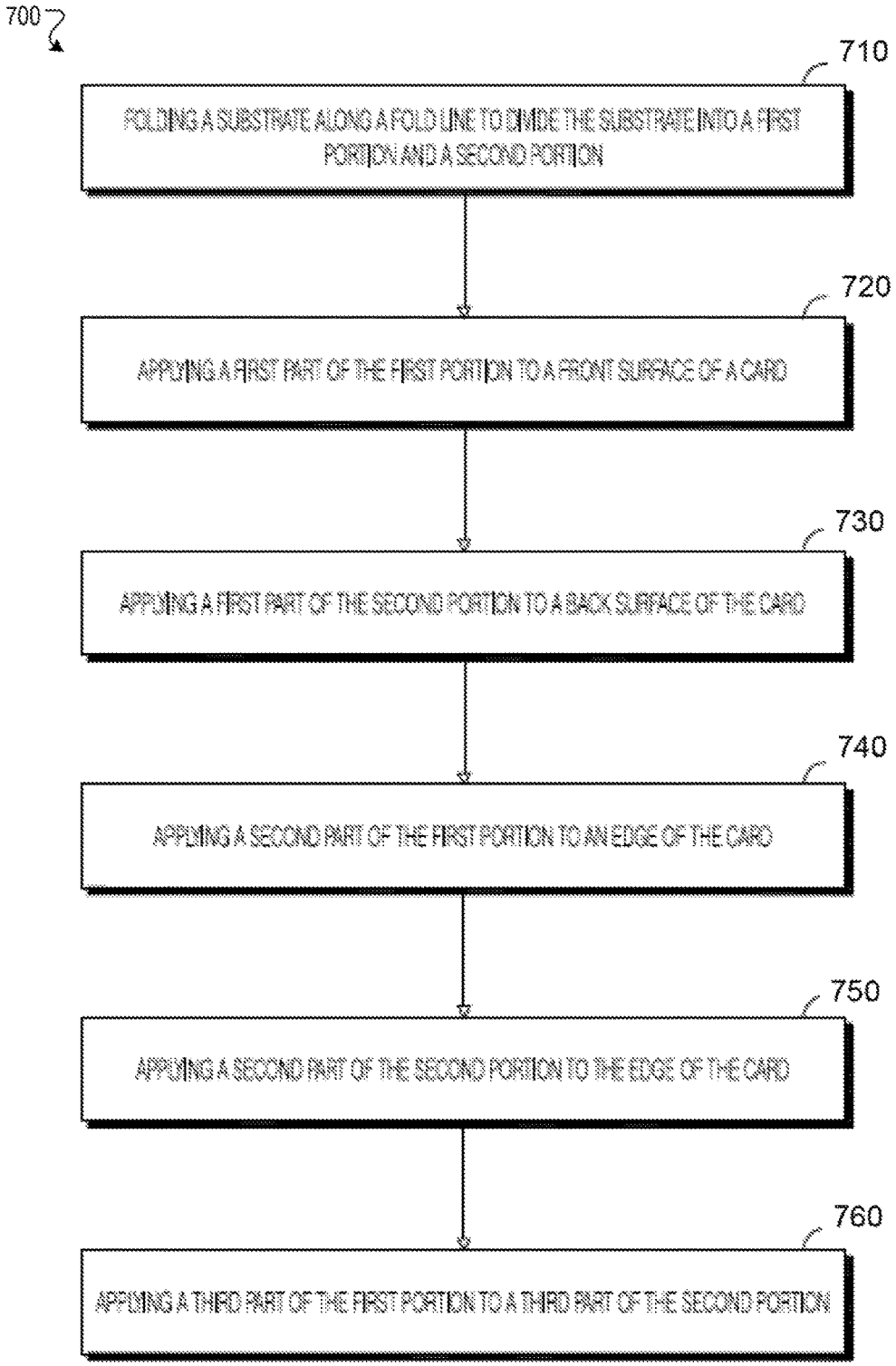
FIG. 7 illustrates a flowchart of a method to attach a card extraction device to a card, according to an embodiment.

FIG. 7 illustrates a flowchart 700 of a method to attach a card extraction device to a card, according to an embodiment. The method may include folding a substrate along a fold line to divide the substrate into a first portion and a second portion (block 710). In one embodiment, an inner surface of the first portion may include an adhesive material. In another embodiment, an inner surface of the second portion may include an adhesive material. The method may include applying a first part of the first portion to a front surface of a card (block 720). The method may include applying a first part of the second portion to a back surface of the card (block 730). The method may include applying a second part of the first portion to an edge of the card (block 740). The method may include applying a second part of the second portion to the edge of the card (block 750). The method may include applying a third part of the first portion to a third part of the second portion (block 760). In one embodiment, the first portion and the second portion may form a substantially flattened body when attached to the card.

The disclosure above encompasses multiple distinct embodiments with independent utility. While each of these embodiments has been disclosed in a particular form, the specific embodiments disclosed and illustrated above are not to be considered in a limiting sense as numerous variations are possible. The subject matter of the embodiments includes all novel and non-obvious combinations and sub-combinations of the various elements, features, functions and/or properties disclosed above and inherent to those skilled in the art pertaining to such embodiments. Where the disclosure or subsequently filed claims recite "an" element, "a first" element, or any such equivalent term, the disclosure or claims are to be understood to incorporate one or more such elements, neither requiring nor excluding two or more such elements.

Applicant(s) reserves the right to submit claims directed to combinations and sub-combinations of the disclosed embodiments that are believed to be novel and non-obvious. Embodiments embodied in other combinations and sub-combinations of features, functions, elements and/or properties may be claimed through amendment of those claims or presentation of new claims in the present application or in a related application. Such amended or new claims, whether they are directed to the same embodiment or a different embodiment and whether they are different, broader, narrower or equal in scope to the original claims, are to be considered within the subject matter of the embodiments described herein.

The invention claimed is:

1. An apparatus comprising:

a substrate that is formed of a substantially flexible material, the substrate comprising:

a first portion, wherein:

an inner surface of the first portion comprises a first adhesive material along approximately an entire surface of the inner surface of the first portion;

an outer surface of the first portion is a non-adhesive surface; and at least a first segment of the first portion is substantially transparent;

a second portion, wherein:

an inner surface of the second portion comprises a second adhesive material along approximately the entire surface of the inner surface of the second portion; and an outer surface of the second portion is the non-adhesive surface; and a fold line between the first portion and the second portion which enables the substrate to be folded, the fold line extending from a first edge of the substrate to a second edge of the substrate, wherein:

a bottom part of the inner surface of the first portion is operable to adhere to a front surface of a card, a middle part of the inner surface of the first portion is operable to adhere to an edge of the card, and a top part of the inner surface of the first portion is operable to adhere to a top part of the inner surface of the second portion; and a bottom part of the inner surface of the second portion is operable to adhere to a back surface of the card, a middle part of the inner surface of the second portion is operable to adhere to the edge of the card, and a top part of the inner surface of the second portion is operable to adhere to a top part of the inner surface of the first portion.

2. The apparatus of claim 1, wherein the card is approximately the dimensions of a credit card.

3. The apparatus of claim 1, wherein the fold line is formed to fold where the first portion of the substrate and the second portion of the substrate meet, which allows the first portion of the substrate to fold relative to the second portion of the substrate.

4. The apparatus of claim 1, wherein the fold line is substantially parallel to a longitudinal axis that extends from the first edge of the substrate to the second edge of the substrate.

5. The apparatus of claim 1, wherein the fold line is user-defined to enable a user to select a first length of the first portion and a second length of the second portion.

6. The apparatus of claim 5, wherein the first length is different than the second length.

7. The apparatus of claim 1, further comprising a hook integrated into the first portion of the substrate or the second portion of the substrate, wherein the hook is operable to grab a surface of the card.

8. The apparatus of claim 1, wherein the substrate is a material that allows a transfer of energy or data between the card and a card-reading device.

9. The apparatus of claim 1, wherein the first adhesive material is different than the second adhesive material.

10. The apparatus of claim 1, wherein the first adhesive material and the second adhesive material are permanent adhesive materials.

11. The apparatus of claim 1, wherein the second portion of the substrate is substantially non-transparent.

12. The apparatus of claim 1, wherein a second segment of the first portion of the substrate is substantially non-transparent.

13. An apparatus comprising:

a substrate that is formed of a substantially flexible material, the substrate comprising:

a first portion, wherein an inner surface of the first portion comprises an adhesive material;

a second portion, wherein an inner surface of the second portion comprises the adhesive material; and a first fold line between the first portion and the second portion which enables the substrate to be folded, the first fold line extending from a first location at an edge of the substrate, wherein:

a bottom part of the inner surface of the first portion is operable to adhere to a front surface of a card and a middle part of the inner surface of the first portion is operable to adhere to an edge of the card;

a bottom part of the inner surface of the second portion is operable to adhere to a back surface of the card and a middle part of the inner surface of the second portion is operable to adhere to the edge of the card; and the first portion and the second portion form a substantially flattened body when attached to the card.

14. The apparatus of claim 13, wherein:

a top part of the inner surface of the first portion is operable to adhere to a segment of the inner surface of the second portion; and a top part of the inner surface of the second portion is operable to adhere to a segment of the inner surface of the first portion.

15. The apparatus of claim 13, wherein the substantially flexible material is weather-proof material and tear-resistant material.

16. The apparatus of claim 13, further comprising a second fold line extending from a second location at the edge of the substrate, wherein the first fold line and the second fold line enable a user to define a length of the first portion and a length of the second portion.

* * * * *